US009073180B2

(12) United States Patent
Yang

(10) Patent No.: US 9,073,180 B2
(45) Date of Patent: Jul. 7, 2015

(54) QUICK RELEASE STRUCTURE OF WOODWORKING CLAMP

(76) Inventor: Ching-Chen Yang, Taichung (TW)

( * ) Notice: Subject to any disclaimer, the term of this patent is extended or adjusted under 35 U.S.C. 154(b) by 229 days.

(21) Appl. No.: 13/621,227

(22) Filed: Sep. 15, 2012

(65) Prior Publication Data

US 2013/0015617 A1 Jan. 17, 2013

Related U.S. Application Data

(63) Continuation-in-part of application No. 12/907,995, filed on Oct. 20, 2010, now abandoned.

(51) Int. Cl.

| | |
|---|---|
| ***B25B 1/02*** | (2006.01) |
| ***B25B 5/06*** | (2006.01) |
| ***B25B 5/10*** | (2006.01) |
| ***B25B 1/12*** | (2006.01) |
| ***B25B 5/16*** | (2006.01) |

(52) U.S. Cl.

CPC . *B25B 5/068* (2013.01); *B25B 5/10* (2013.01); *B25B 1/12* (2013.01); *B25B 1/125* (2013.01); *B25B 5/166* (2013.01)

(58) Field of Classification Search

USPC ..... 269/208

See application file for complete search history.

(56) References Cited

U.S. PATENT DOCUMENTS

| | | | | |
|---|---|---|---|---|
| 7,172,183 | B1 * | 2/2007 | Yang | 269/6 |
| 7,322,572 | B1 * | 1/2008 | Yang | 269/6 |
| 2006/0131802 | A1 * | 6/2006 | Fuller et al. | 269/6 |
| 2008/0043660 | A1 * | 2/2008 | White | 370/313 |
| 2010/0013133 | A1 * | 1/2010 | Strauss | 269/6 |
| 2012/0098182 | A1 * | 4/2012 | Yang | 269/208 |

* cited by examiner

*Primary Examiner* — Lee D Wilson
*Assistant Examiner* — Alvin Grant

(57) ABSTRACT

A quick release structure for a woodworking clamp, which has a clamp body slidingly connected to the transverse rod, and the securing chuck having a securing rod disposed through a securing hole of the transverse rod. One side of the securing chuck is formed with an accommodating portion, both sides of the accommodating portion are connected to a quick release element, a positioning shaft respectively is disposed on the quick release element, the positioning shaft is placed through the shaft aperture; an outer surface of the quick release element is provided with a pressing portion. When the quick release element is connected into the accommodating portion, by compressing the elastic element, the securing rod is driven to release from the securing hole. When the pressing portion is not pressed, the elastic element bounces back to retract the quick release element to secure the securing chuck onto the transverse rod.

4 Claims, 8 Drawing Sheets

QUICK RELEASE STRUCTURE OF WOODWORKING CLAMP

CROSS-REFERENCE TO RELATED APPLICATIONS

This application is a continuation-in-part of U.S. application Ser. No. 12/907,995, filed on Oct. 20, 2010, now abandoned the contents of which are incorporated herein by reference.

BACKGROUND OF THE INVENTION

1. Field of the Invention

The present invention relates to a woodworking clamp, and in particular to a quick release structure for a woodworking clamp.

2. Description of the Related Art

When several plate-like workpieces such as wood plates, metallic plates, plastic plates or the like are to be bound together or machined at the same time, a large-sized portable clamp is used for clamping these plates together because a stationary clamp such as a vise fixed on a work bench cannot be moved to meet the positions of the plates. A common portable clamp has a transverse positioning rod on which a clamp body and a chuck are provided. By adjusting the position of the clamp body relative to the chuck, the portable clamp can be used to clamp several plates, the clamp fixes a workpiece onto the work bench in two ways. One way is to sandwich the workpiece between a fixed end and a movable end of the clamp, in which the movable end moves along a guiding rod toward the fixed end to sandwich the workpiece therebetween. The other way is to support the workpiece having an inner hole, in which the fixed end and the movable end of the clamp are disposed into the inner hole, and then the movable end moves along a guiding rod away from the fixed end to thereby hold the workpiece.

Therefore, it is desirable to provide a quick release structure for a woodworking clamp to mitigate and/or obviate the aforementioned problems.

SUMMARY OF THE INVENTION

An objective of the present invention is to provide a quick release structure for a woodworking clamp which can be disassembled quickly.

In order to achieve the above object, embodiments of the present invention provide a quick release structure for a woodworking clamp, which includes a clamp body, a transverse rod and a securing chuck. The upper edge of the clamp body is provided with a movable chuck. The clamp body is slidingly connected on one end of the transverse rod. The securing chuck has a securing rod disposed through a securing hole of the transverse rod, thereby fixing the fixed rod to the other end of the transverse rod. One end of the securing rod is provided with two pivoting portions. The positioning portions may be integrally formed with the securing rod. Alternatively, the outer end of the securing rod is connected to a connecting block, and both sides of the top surface of the connecting block are provided with the pivoting portion, respectively.

one side of the securing chuck which the transverse rod is disposed through is formed with an accommodating portion, both sides of the accommodating portion are respectively provided with a shaft aperture for pivotally connecting to a quick release element, a positioning shaft respectively is disposed on a lower portion of two outer sides of the quick release element, the positioning shaft is placed through the shaft aperture; an outer surface of the quick release element is provided with a pressing portion, two opposite inner walls of the quick release element are formed with an elongate pivotal hole respectively for allowing the pivoting portions of the securing rod to be pivotally connected thereto, a protruding portion is formed corresponding to a lower portion of pressing portion and provided with an elastic element; when the quick release element is pivotally connected into the accommodating portion of the securing chuck, by compressing the elastic element, the securing rod is driven to release from the securing hole; in contrary, when the pressing portion is not pressed, the elastic element bounces back to retract the quick release element to drive the securing rod to move inwardly to pass through the securing hole of the transverse rod, to secure the securing chuck onto the transverse rod.

DETAILED DESCRIPTION OF THE INVENTION

Figure 1:
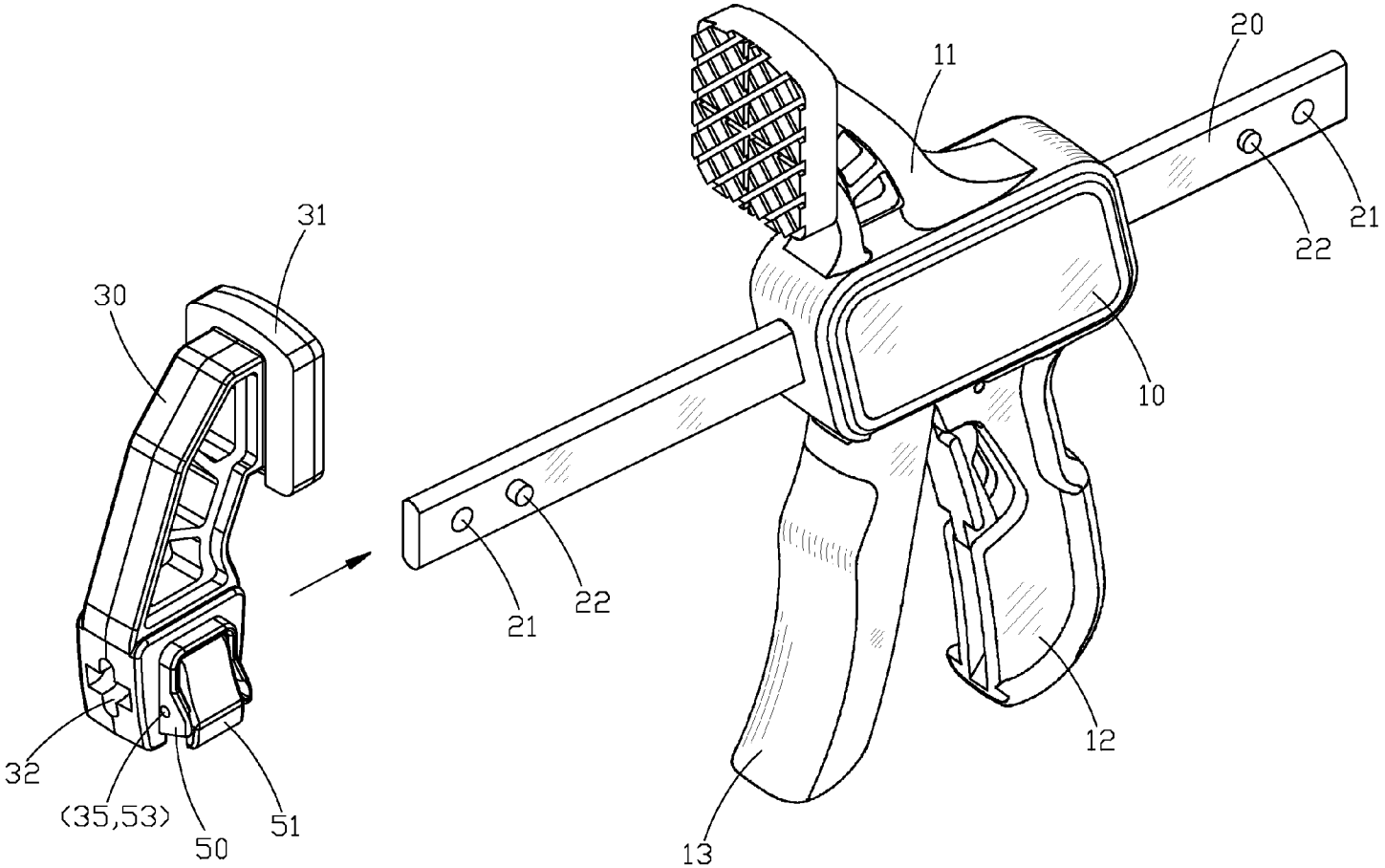
FIG. 1 is an exploded perspective view of an embodiment of the present invention.
Figure 2:
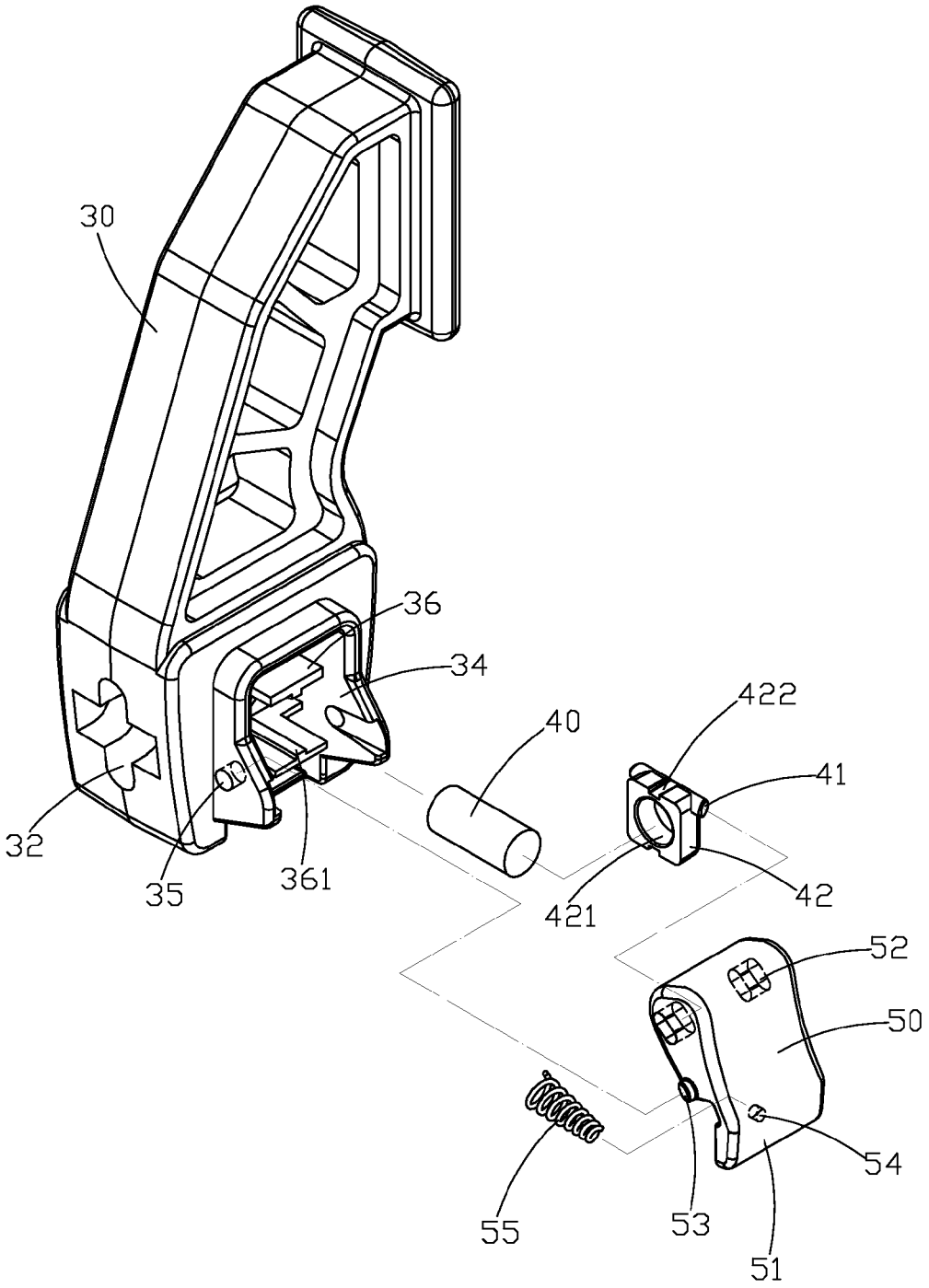
FIG. 2 is another exploded perspective view of an embodiment of the present invention.
Figure 3:
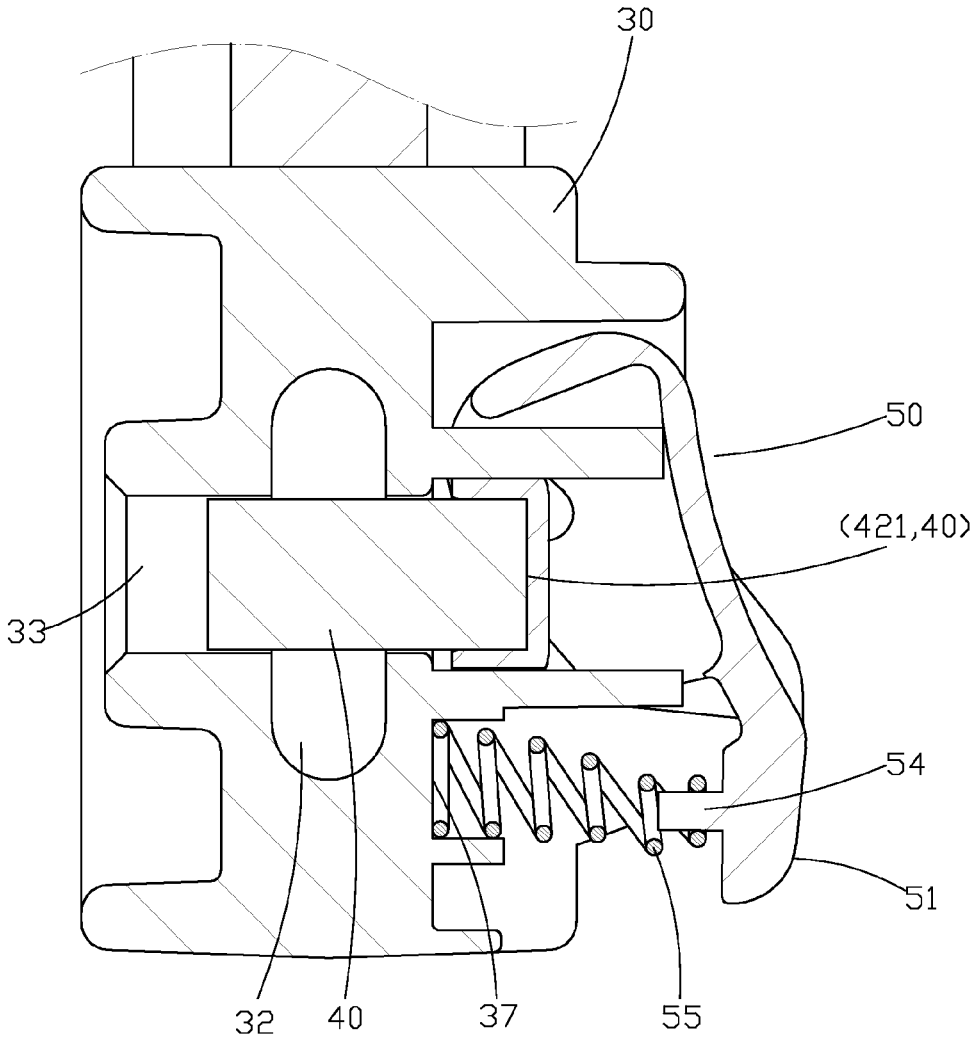
FIG. 3 is a cross-sectional view showing an embodiment of the present invention in a secured state.

Please refer to FIGS. 1 to 8. Embodiments of the present invention provide a quick release structure for a woodworking clamp, which includes a clamp body 10, a transverse rod 20, a securing chuck 30, a securing rod 40, and a quick release element 50. The securing rod 40 and a quick release element 50 are used for securing the securing chuck 30 to the transverse rod 20.

The clamp body 10 has an inner hollow portion through which the transverse rod 20 is disposed. An engaging member not shown is provided on the clamp body 10. A movable chuck 11 protrudes from the upper surface of the clamp body 10. A grip 12 and a trigger 13 are provided on the lower surface the clamp body 10. The trigger 13 drives the engaging member to engage with or disengage from the transverse rod 20, so that the movable chuck 11 of the clamp body 10 can slide on the transverse rod 20. The movable chuck 11 is conventional and thus the description thereof is omitted.

The transverse rod 20 allows the clamp body 10 to slide thereon. Both ends of the transverse rod 20 are provided near its edge with a securing hole 21 and a restricting portion 22 respectively. The restricting portion 22 is configured to allow the securing chuck 30 to be fixed to a desired position. Then, the securing rod 40 is disposed through the securing hole 21 to thereby fix the securing chuck 30.

A clamping portion 31 is provided in the upper portion of the securing chuck 30. A cross-like through-hole 32 is provided in a lower portion of the securing chuck 30. The radial inner edge of the securing chuck 30 is provided with an engaging hole 33 perpendicular to the through-hole 32. The securing rod 40 is sequentially disposed through the engaging hole 33 and the securing hole 21, thereby connecting the securing chuck 30 to the transverse rod 20. One side of the securing chuck 3 opposite the engaging hole 33 is formed with an accommodating portion 34. Both sides of the lower portion of the accommodating portion 34 are provided with a shaft hole 35 respectively for allowing the quick release element 50 to be pivotally connected thereto. Two facing surfaces of the portioning plates 36 are provided with a rib 361.

The securing rod 40 is provided with two pivoting portions 41 facing each other at one end adjacent to the quick release element 50. The two pivoting portions 41 may be integrally formed with the securing rod 40. Alternatively, in the present embodiment, the two pivoting portions 41 may be assembled with the securing rod 40. That is, the securing rod 40 is made of metallic materials. One end of the securing rod 40 is connected to a positioning slot of a connecting block 42 made of plastic materials. The two positioning portions 41 are provided on both sides of the top end of the connecting block 42. The upper surface and the lower surface of the connecting block 42 are provided with a trough 421 respectively. The securing chuck 30 is provided with two partitioning plates 39 in the accommodating portion 34 to correspond to the engaging hole 33. The ribs 361 of the portioning plates 36 are provided with a rib 391 respectively for insertion into the trough 421 when the connecting block 42 is disposed on the portioning plate 39.

Figure 6:
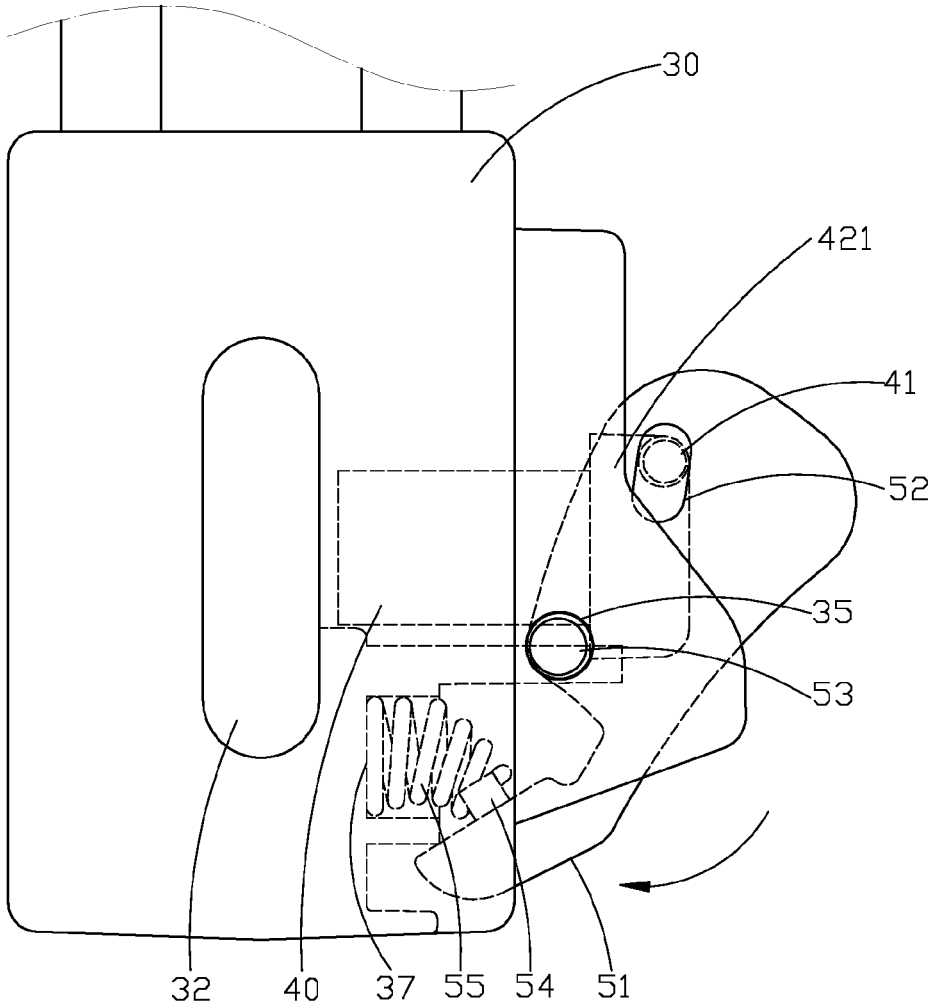
FIG. 6 is a schematic view showing the state after a securing rod is removed from a securing hole
Figure 7:
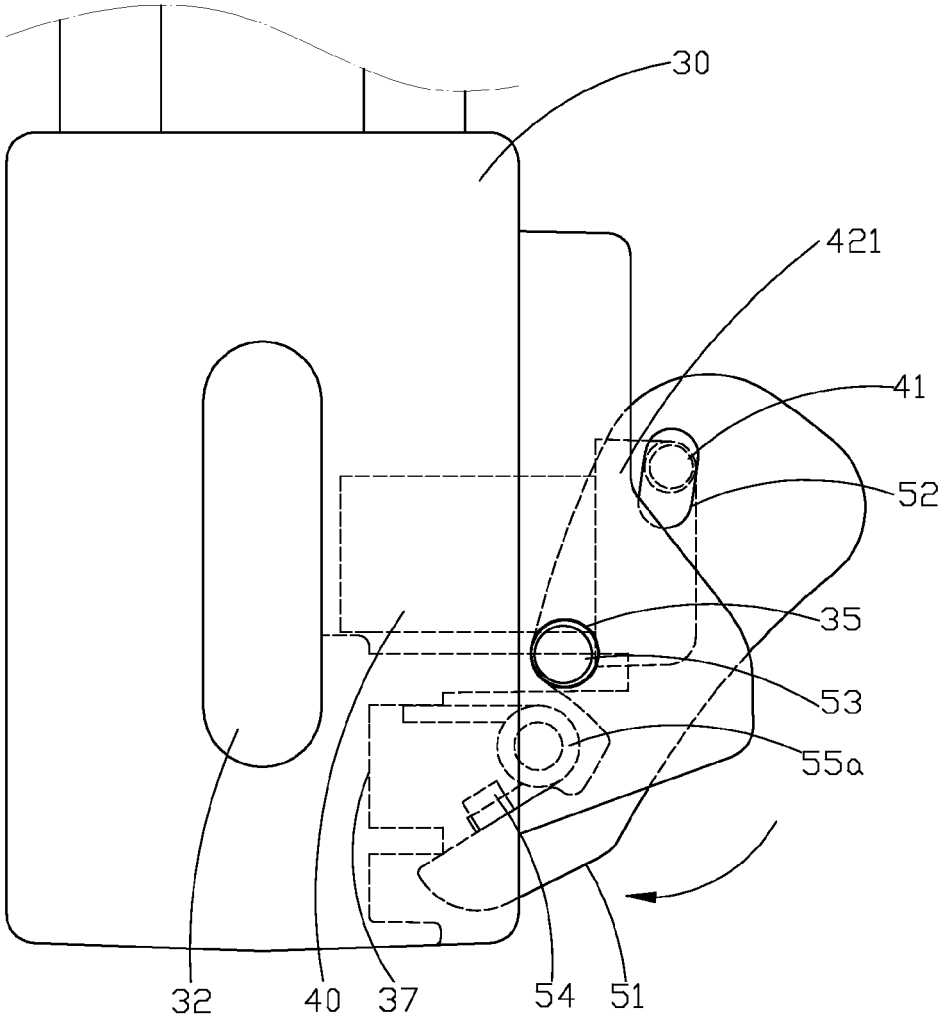
FIG. 7 is a schematic view of a torsion spring being used as an elastic element according to an embodiment of the present invention.
Figure 8:
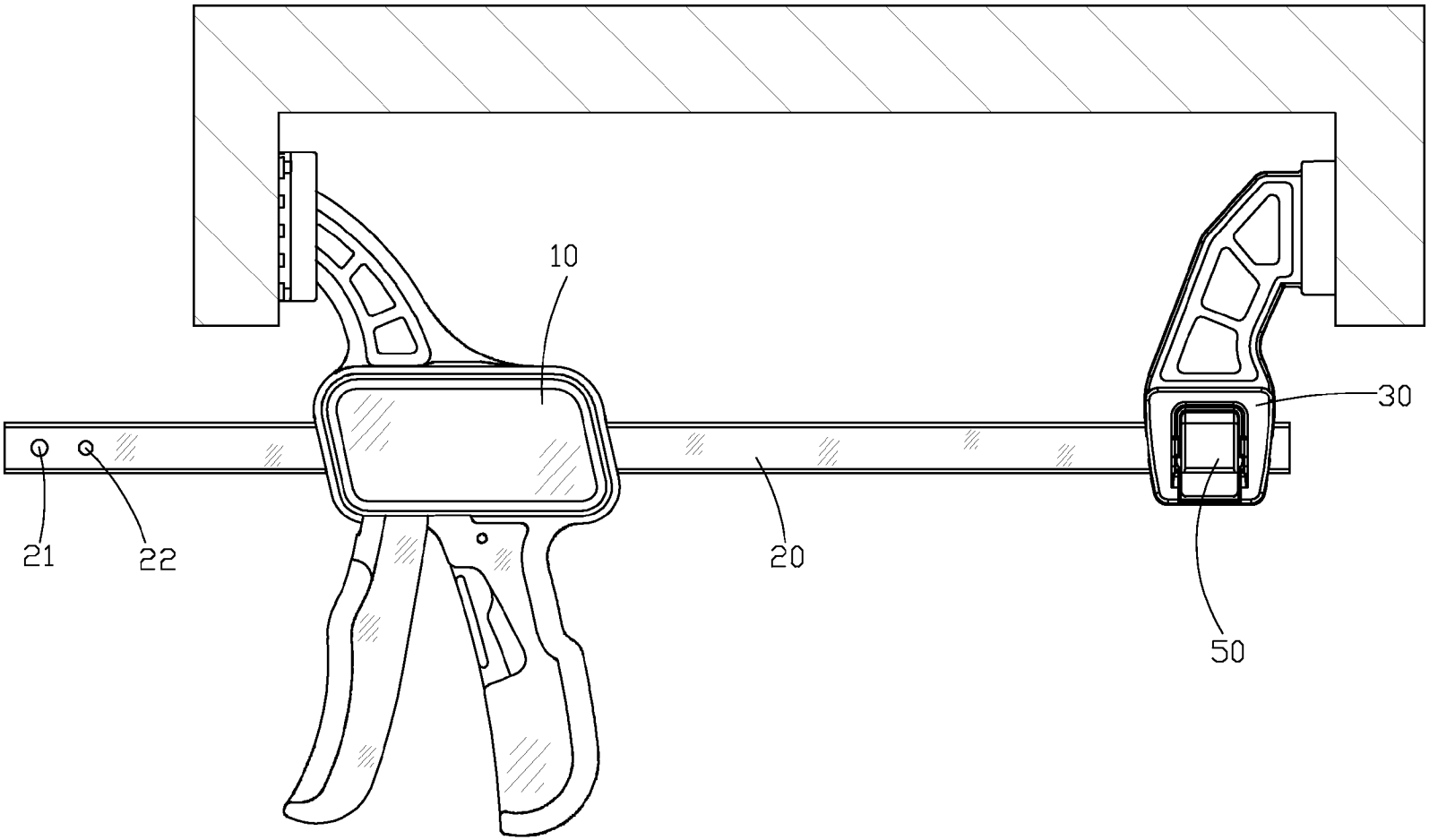
FIG. 8 is a schematic view showing another operating mode of an embodiment of the present invention for clamping an article

The quick release element 50 is provided on its outer surface with a curved pressing portion 51. Two opposite outer surfaces of the quick release element 50 are provided with a pivoting hole 52 respectively, and a positioning shaft 53 is provided below the pivoting hole 52. The pivoting portions 41 of the securing rod 40 are pivotally engaged within the pivotal holes 52 respectively to be drivingly connected with the quick release element 50. With the two positioning shafts 53 disposed into the two shaft holes 35 of the securing chuck 30, the quick release element 50 is pivotally connected into the accommodating portion 34 of the securing chuck 30. A protruding portion 54 on the quick release element 50 is formed correspondingly below the two pivoting holes 52 such that a smaller end of the elastic element 55 is jacketed onto the protruding portion 54 and a larger end of the elastic element 55 pushes against an applying area 37 form below the accommodating portion 34 of the securing chuck 30. The elastic element 55 is a compression spring (as shown in FIG. 6) or a torsion spring (as shown in FIG. 7.) In this embodiment, elastic element 55 is a compression spring.

Therefore, with the above structure, a user presses the quick release element 50 to utilize the elastic element to cause the securing rod 40 to horizontally remove from the securing hole 21. When the user release the quick release element 50 due to the elasticity of the elastic element, the securing rod 40 is retracted to horizontally pass through the securing hole 21.

Figure 4:
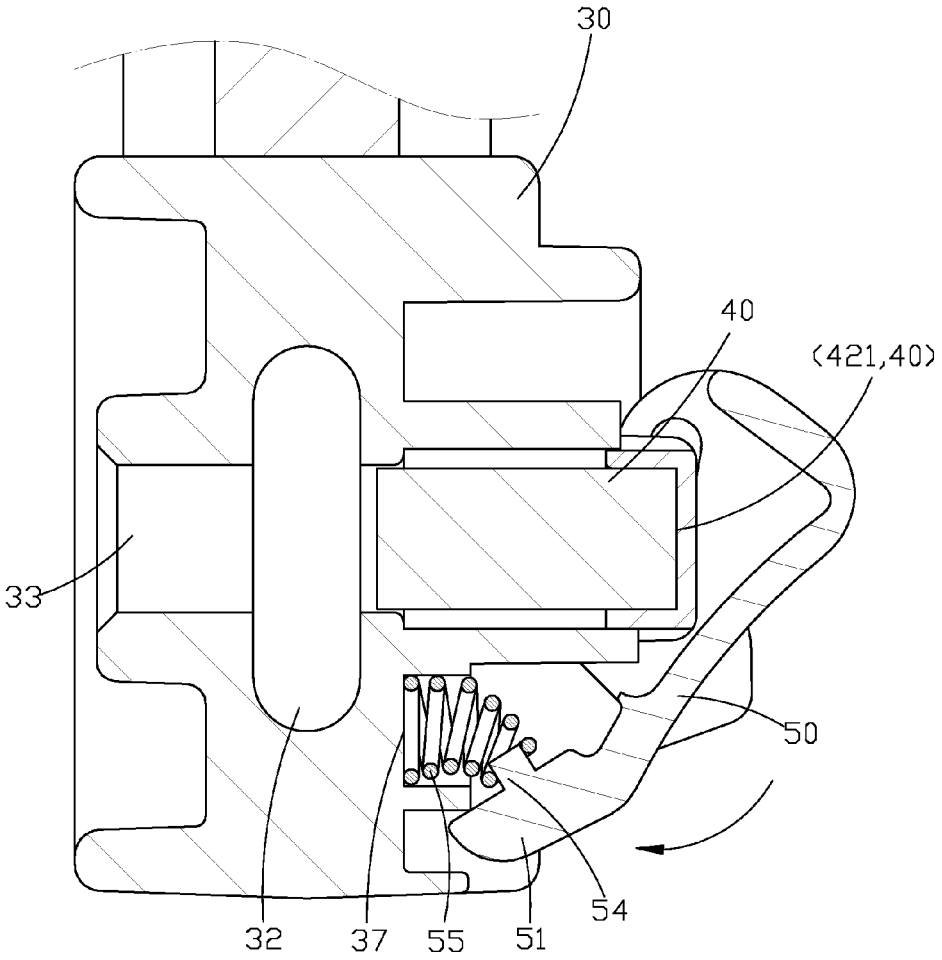
FIG. 4 is a cross-sectional view showing an embodiment of the present invention in a detached state.
Figure 5:
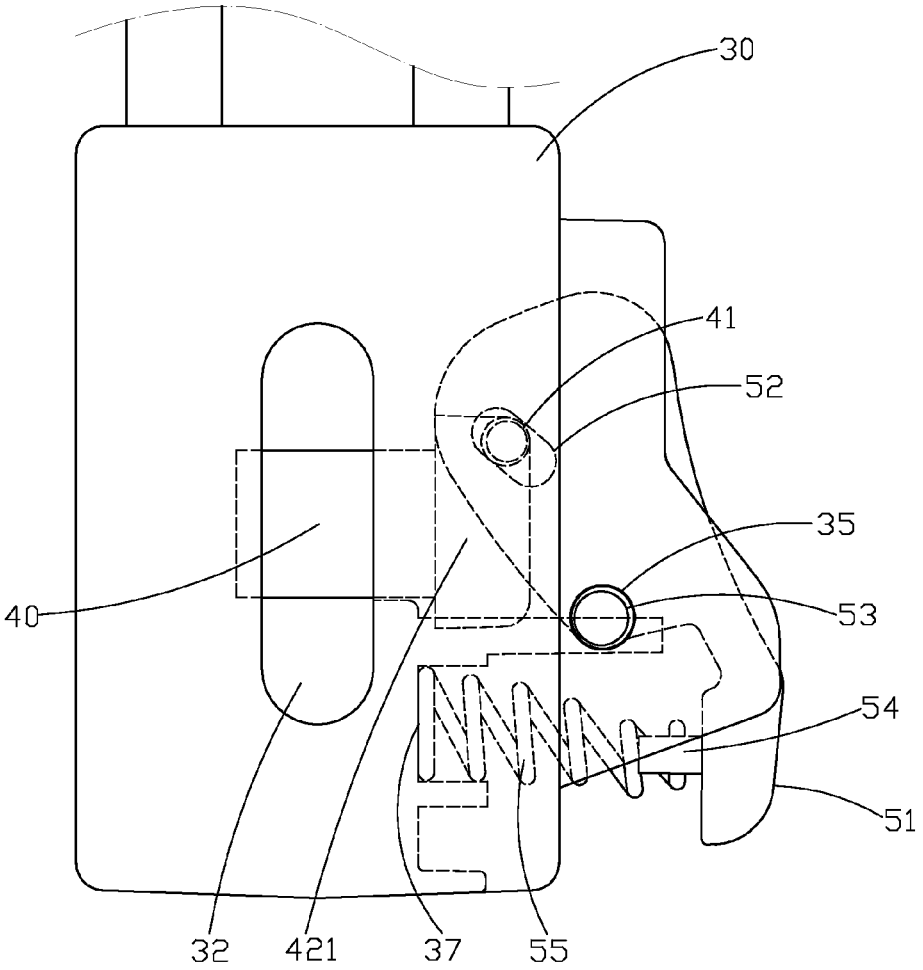
FIG. 5 is a schematic view showing the state before a securing rod is removed from a securing hole.

Please refer to FIGS. 3 to 6. When the user intends to change the manner of clamping an article with the movable chuck 11 and the securing chuck 30, the user needs only to press the pressing portion 51 of the quick release element 50 to active the elastic element 55. As shown in FIGS. 4 and 6, when the securing chuck 30 is fixed by the securing rod 40, the elastic element 55 of the quick release element 50 is compressed due to the pressing of the lower end of the pressing portion 51. In this way, the quick release element 50 swings by using the positioning shaft 53 as a center of rotation, so that the securing rod 40 rotates accordingly because the two pivoting portions 41 are pivotally disposed in the pivotal hole 52. As a result, the securing rod 40 moves horizontally to remove from the securing hole 21 of the transverse rod 20, thereby detaching the securing chuck 30.

On the other hand, when the user intends to secure the securing chuck 30, the user releases the pressing portion 51 to release the elastic element 55, to cause the quick release element 50 to swing reversely. As a result, the securing rod 40 is driven to move inwardly and horizontally so as to pass through the securing hole 21 of the transverse rod 20, as shown in FIG. 4 and FIG. 6.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A quick release structure for a woodworking clamp, comprising a clamp body, a transverse rod and a securing chuck, an upper edge of the clamp body being provided with a movable chuck, the clamp body being slidingly connected to an end of the transverse rod, the securing chuck having a securing rod disposed through a securing hole of the transverse rod to thereby fix the securing chuck to another end of the transverse rod, characterized in that:

an end of the securing rod is provided with two pivoting portions, one side of the securing chuck which the transverse rod is disposed through is formed with an accommodating portion, opposing sides of the accommodating portion are respectively provided with a shaft aperture for pivotally connecting to a quick release element, a positioning shaft respectively is disposed on a lower portion of two outer sides of the quick release element, the positioning shaft placed through the shaft apertures;

an outer surface of the quick release element is provided with a pressing portion, two opposite inner walls of the quick release element are formed with an elongate pivotal hole respectively for allowing the pivoting portions of the securing rod to be pivotally connected thereto, a protruding portion is formed corresponding to a lower portion of the pressing portion and provided with an elastic element; wherein when the quick release element is pivotally connected into the accommodating portion of the securing chuck, by compressing the elastic element, the securing rod is driven to release from the securing hole; and when the pressing portion is not pressed, the elastic element returns to retract the quick release element to drive the securing rod to move inwardly to pass through the securing hole of the transverse rod, to secure the securing chuck onto the transverse rod.

2. The quick release structure of a woodworking clamp according to claim 1, wherein the positioning portion is integrally formed on one end of the securing rod.

3. The quick release structure of a woodworking clamp according to claim 1, wherein a positioning slot of a connecting block is connected to an outer surface of the pivoting portion of the securing rod, opposing sides of a top end of the connecting block are provided with a respective pivoting area, upper and lower surfaces of the connecting block are provided with a respective trough, the interior of the securing chuck is provided with two partitioning plates in the accommodating portion to correspond to the securing hole through which the securing rod is inserted, two facing surfaces of the two partitioning plates are provided with a respective rib, and each rib is inserted into the corresponding trough when the connecting block is disposed on the partitioning plates.

4. The quick release structure of a woodworking clamp according to claim 1, wherein the elastic element is a compression spring or a torsion spring.

* * * * *